US012104616B1

(12) United States Patent
Liu

(10) Patent No.: US 12,104,616 B1
(45) Date of Patent: Oct. 1, 2024

(54) HANDHELD FAN

(71) Applicant: Shulin Liu, Shenzhen (CN)

(72) Inventor: Shulin Liu, Shenzhen (CN)

( * ) Notice: Subject to any disclaimer, the term of this patent is extended or adjusted under 35 U.S.C. 154(b) by 0 days.

(21) Appl. No.: 18/418,263

(22) Filed: Jan. 20, 2024

(30) Foreign Application Priority Data

Dec. 29, 2023 (CN) ..... 202323663756.8

(51) Int. Cl.
*F04D 25/08* (2006.01)
*F04D 29/34* (2006.01)
*F04D 29/52* (2006.01)

(52) U.S. Cl.
CPC ..... *F04D 29/522* (2013.01); *F04D 25/084* (2013.01); *F04D 29/34* (2013.01)

(58) Field of Classification Search
CPC ..... F04D 25/084; F05D 29/522; F05D 29/34
See application file for complete search history.

(56) References Cited

U.S. PATENT DOCUMENTS 6,109,874 A * 8/2000 Steiner ..... F04D 25/084 416/240
7,775,848 B1 * 8/2010 Auerbach ..... F04D 25/084 446/73
11,953,017 B1 * 4/2024 Chen ..... F04D 25/0673

* cited by examiner

*Primary Examiner* — Michael L Sehn
(74) *Attorney, Agent, or Firm* — Jeenam Park

(57) ABSTRACT

Disclosed is a handheld fan, including a main body, a housing cover and a fan blade. The main body includes a handheld area and a fan blade area longitudinally arranged, the main body is internally provided with a driving device, the driving device drives the fan blade to rotate, a sliding connecting structure is arranged between the main body and the housing cover, the housing cover leans against the sliding connecting structure and slides relative to the main body, and the housing cover has two working positions, one for covering the fan blade area and the other for exposing the fan blade area.

10 Claims, 14 Drawing Sheets

HANDHELD FAN

CROSS-REFERENCE TO RELATED APPLICATIONS

The application claims priority to Chinese patent application No. 202323663756.8, filed on Dec. 29, 2023, the entire contents of which are incorporated herein by reference.

TECHNICAL FIELD

The present invention relates to the technical field of handheld fans, and particularly relates to a handheld fan.

BACKGROUND

A handheld fan is a fan capable of being held by a palm, which is a chargeable mobile fan. In the conventional technologies, the handheld fan usually uses a fixed handle, which, to a certain extent, brings restriction and inconvenience to a user when being stored and carried.

Therefore, to achieve portable use of the handheld fan, it is necessary to design a special handheld fan convenient to store and carry.

SUMMARY

To overcome defects in the prior art, the present invention provides a handheld fan. By arranging a sliding connecting structure between a main body and a housing cover, the housing cover can slide relative to the main body, so that the main body is stored in the housing cover, and therefore, the volume of the handheld fan is reduced and the handheld fan is convenient to store.

To achieve the above object, the present invention employs the following technical solution:

a handheld fan includes a main body, a housing cover and a fan blade, where the main body includes a handheld area and a fan blade area longitudinally arranged, the main body is internally provided with a driving device, the driving device drives the fan blade to rotate, a sliding connecting structure is arranged between the main body and the housing cover, the housing cover leans against the sliding connecting structure and slides relative to the main body, and the housing cover has two working positions, one for covering the fan blade area and the other for exposing the fan blade area. By arranging a sliding connecting structure between the main body and the housing cover, the housing cover can slide relative to the main body, so that the main body is stored in the housing cover, and therefore, the volume of the handheld fan is reduced and the handheld fan is convenient to store.

As a preferred solution, the sliding connecting structure includes a chute and a sliding block, and the sliding block is embedded into the chute and is in clearance fit with the chute.

As a preferred solution, the chute is formed in the main body and extends along the main body, and the sliding block is arranged on the housing cover.

As a preferred solution, there are at least two chutes respectively formed on left and right sides of the fan blade area.

As a preferred solution, the housing cover includes a rear side wall, a left side wall, a right side wall and a lower side wall, a front side of the housing cover is opened to form a first opening, an upper side of the housing cover is opened to form a second opening, and the first opening is connected to the second opening.

As a preferred solution, there are at least two sliding blocks respectively arranged in positions, close to the second opening, of inner walls of the left side wall and the right side wall.

As a preferred solution, each of the sliding blocks is strip-shaped, and the sliding block extends longitudinally.

As a preferred embodiment, the sliding block is cylinder.

As a preferred solution, the sliding block includes a column portion, the column portion is provided with a section, the chute is in clearance fit with the section, and a width of a non-section position of the column portion is greater than a width of a section position of the column portion.

As a preferred solution, a tail end of the chute is provided with a round hole, the non-section position of the column portion is in clearance fit with the round hole, and a diameter of the round hole is greater than a width of the chute.

As a preferred solution, the sliding block is T-shaped and includes a column portion and a hook portion, the hook portion protrudes out of the column portion radially, the chute is further internally provided with an avoidance groove, and a width of the avoidance groove is greater than the width of the chute, and the hook portion is in clearance fit with the avoidance groove.

As a preferred solution, the housing cover includes a first shielding portion corresponding to the handheld area and a second shielding portion corresponding to the fan blade area.

As a preferred solution, the fan blade includes a first blade, a second blade and a connector, the first blade and the second blade are rotatably connected to the connector, and an output end of the driving device is in driving connection to the first blade and the second blade through the connector.

Compared with the prior art, the present invention has obvious advantages and beneficial effects. Specifically, by arranging the sliding connecting structure between the main body and the housing cover, the housing cover can slide relative to the main body, so that the housing cover has the two working positions, one for covering the fan blade area and the other for exposing the fan blade area, and therefore, the volume of the handheld fan is reduced and an effect that the handheld fan is convenient to store is achieved; and the housing cover shields the fan blade area to further protect the fan blade, so as to prevent the fan blade from being damaged, and thus, the service life of the handheld fan is prolonged.

In order to explain structural features and technical means of the present invention, and specific objects and functions achieved thereby, the present invention will be further described in detail below in combination with drawings and specific embodiments.

DESCRIPTION OF NUMERALS IN DRAWINGS

Figure 1:
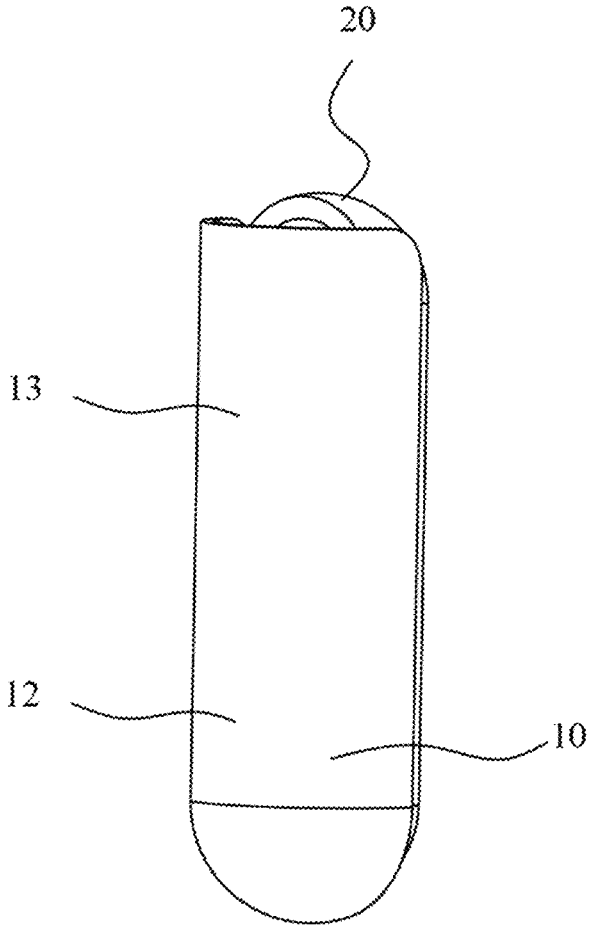
FIG. 1 is a schematic diagram of an assembled structure in a stored state of an embodiment 1 of the present invention.
Figure 2:
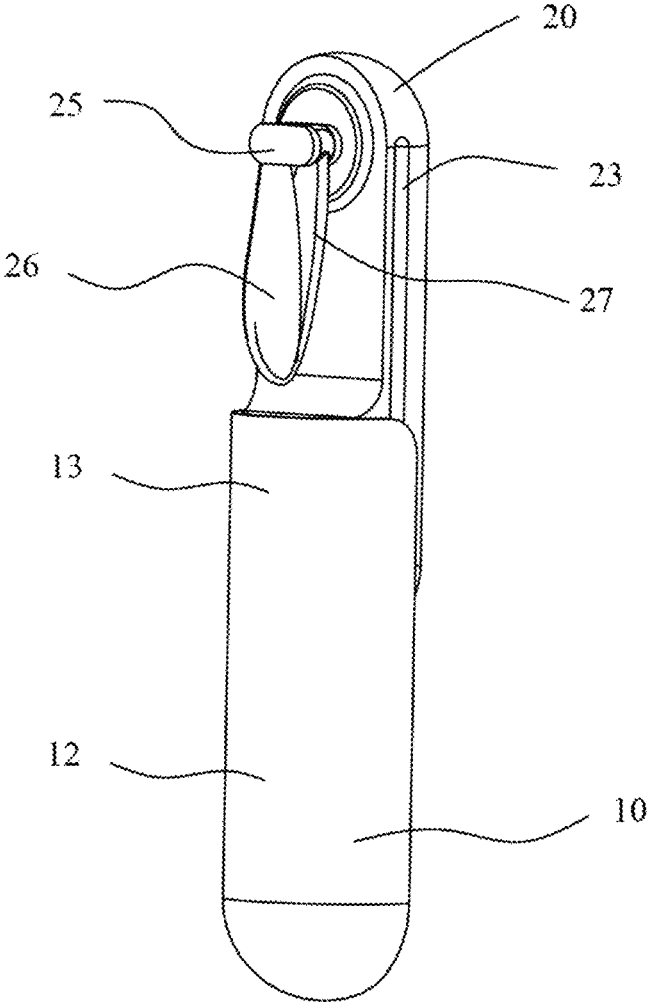
FIG. 2 is a schematic diagram of the assembled structure in an unfolded state of the embodiment 1 of the present invention.
Figure 3:
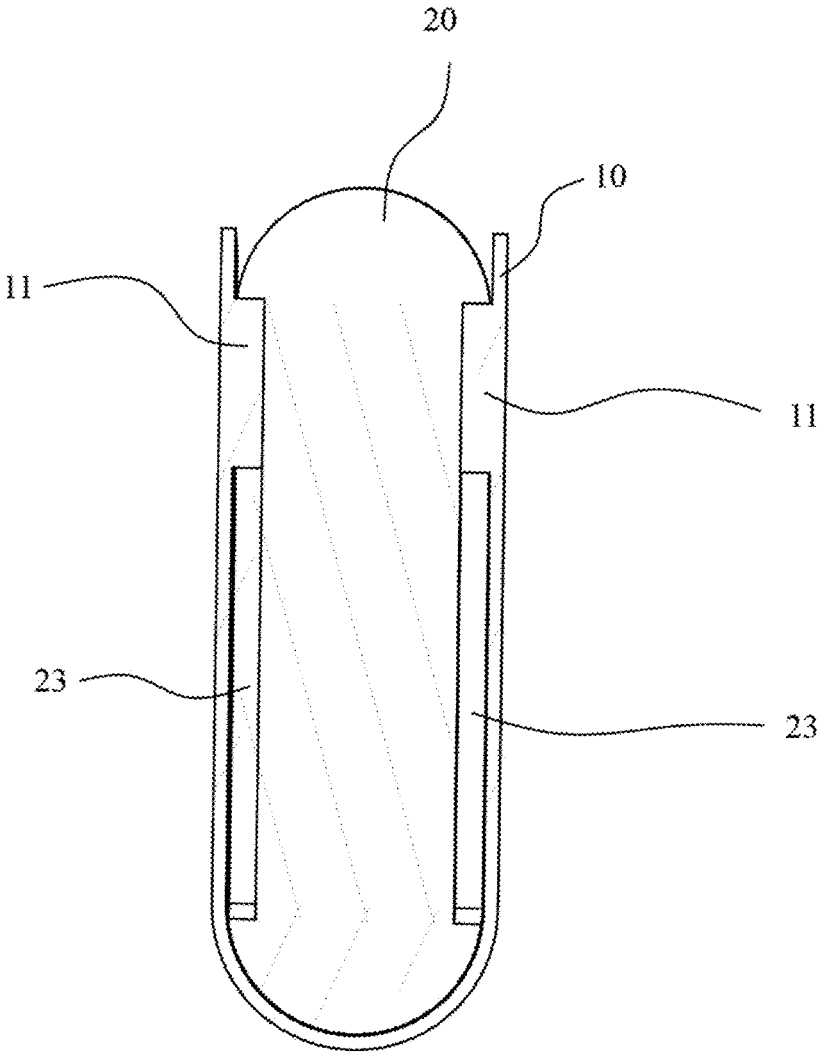
FIG. 3 is a section view of the embodiment 1 of the present invention.

10, housing cover; 101, rear side wall; 102, left side wall; 103, right side wall; 104, lower side wall; 11, sliding block;

12, first shielding portion; 13, second shielding portion; 14, first opening;

15, second opening; 20, main body; 21, handheld area;

22, fan blade area; 23, chute; 24, cambered surface;

25, connector; 26, first blade; 27, second blade;

30, column portion; 31, section; 32, hook portion;

33, round hole; 34, avoidance groove.

DETAILED DESCRIPTION OF THE EMBODIMENTS

In description of the present invention, it is to be noted that orientation or position relationships indicated by terms: "central", "upper", "lower", "left", "right", "vertical", "horizontal', "inner", "outer" and the like are orientation or position relationships indicated by the drawings and are only to describe the present invention and simplify the description rather than indicates or implies that the indicated device or components must have specific orientations and are configured and operated in the specific orientations. Therefore, it cannot be construed as limitations to the present invention.

In the description of the present invention, it should be noted that, unless otherwise explicitly specified and defined, the terms "mounting", "connecting" and "connection" should be understood in a broad sense, for example, they may be a fixed connection, a detachable connection, or an integrated connection; may be a mechanical connection, or an electrical connection; and may be a direct connection, or an indirect connection via an intermediate medium, or communication inside two elements. Those of ordinary skill in the art may understand the specific meanings of the foregoing terms in the present disclosure according to specific situations.

Embodiment 1

As shown in FIGS. 1-4, disclosed is a handheld fan, including a main body 20, a housing cover 10 and a fan blade. The main body 20 includes a handheld area 21 and a fan blade area 22 longitudinally arranged, and the handheld area 21 and the fan blade area 22 are integrally formed. The main body 20 is internally provided with a driving device, the driving device drives the fan blade to rotate, and the driving device can be driven by an existing motor, which is not described in detail herein. The main body can further be provided with a battery, a control panel, a circuit board, and the like. A sliding connecting structure is arranged between the main body 20 and the housing cover 10 and includes a chute 23 and a sliding block 11, the sliding block 11 is embedded into the chute 23, the sliding block 11 is in clearance fit with the chute 23, the housing cover 10 leans against the sliding connecting structure and slides relative to the main body 20, and the housing cover 10 has two working positions, one for covering the fan blade area 22 and the other for exposing the fan blade area 22.

Figure 4:
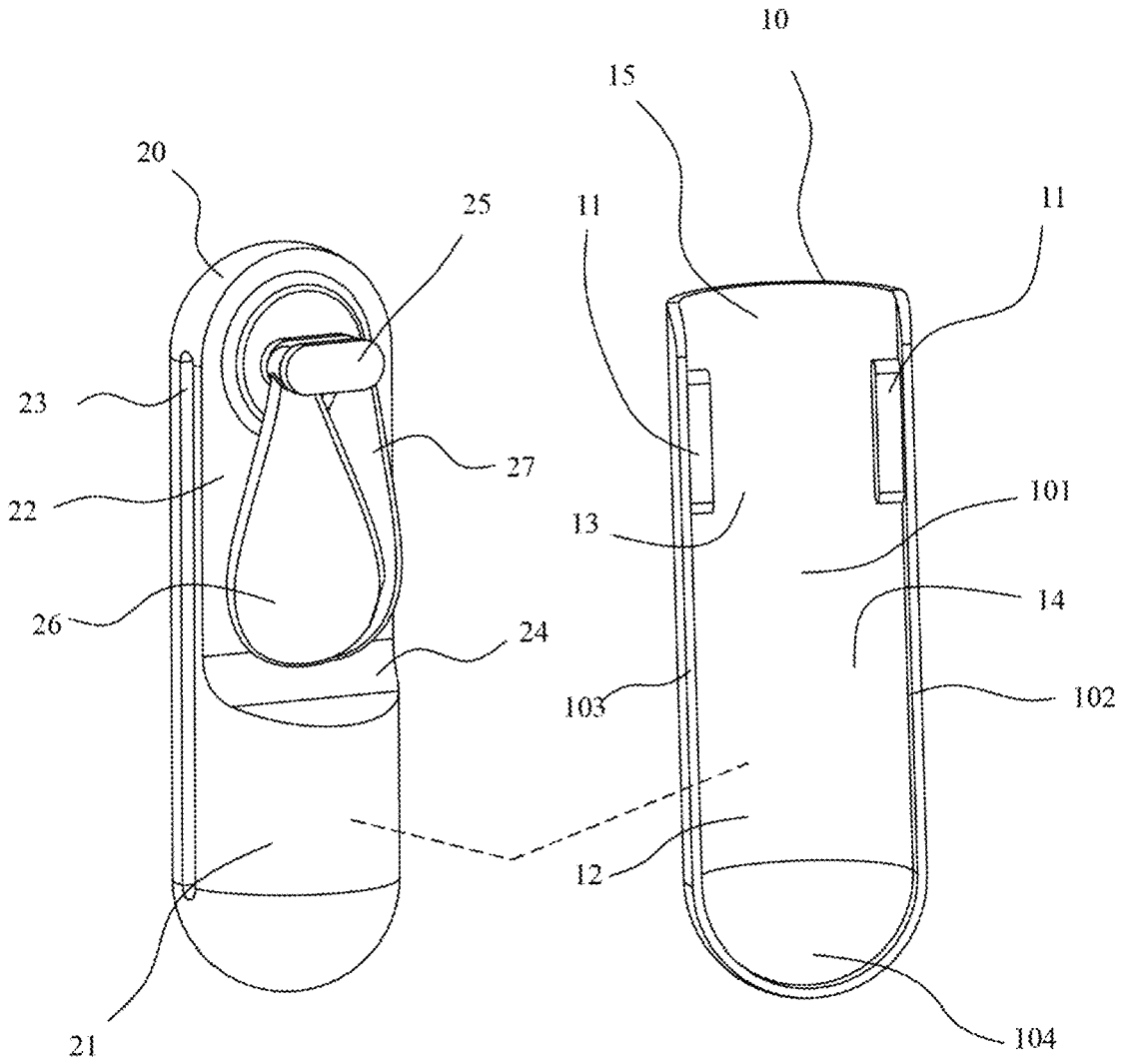
FIG. 4 is a schematic diagram of a breakdown structure of the embodiment 1 of the present invention.

As shown in FIG. 4, by arranging the sliding connecting structure between the main body 20 and the housing cover 10, the housing cover 10 can slide relative to the main body 20. When the housing cover 10 slides to cover the fan blade area 22, the main body 20 can be stored in the housing cover 10, so that the volume of the handheld fan is reduced and the handheld fan is convenient to store. When the housing cover 10 slides to expose the fan blade area 22, it can be used as a handle, and it is more conveniently held by a user by increasing a length of the handle.

The housing cover 10 includes a rear side wall 101, a left side wall 102, a right side wall 103 and a lower side wall 104, a front side of the housing cover 10 is opened to form a first opening 14, an upper side of the housing cover 10 is opened to form a second opening 15, and the first opening 14 is connected to the second opening 15.

The chutes 23 are formed in both sides of the fan blade area 22 and extend along the main body 20 longitudinally. The sliding blocks 11 are respectively arranged in positions, close to the second opening 15, of inner walls of the left side wall 102 and the right side wall 103 of the housing cover 10. There are two chutes 23 and there are two sliding blocks 11. It is to be understood that one or more sliding blocks 11 can also be arranged on the housing cover 10, and one or more chutes 23 where the sliding blocks 11 can be embedded into are formed in the main body 20.

The sliding block 11 is strip-shaped and extends along the housing cover 10 longitudinally, so that the sliding block 11 can be embedded into the chute 23. The sliding block 11 is in clearance fit with the chute 23. By designing the strip-shaped sliding block 11, the housing cover 10 can only slide relative to the main body 20 rather than rotating, so that a using function is relatively simple and practical.

The housing cover 10 includes a first shielding portion 12 corresponding to the handheld area 21 and a second shielding portion 13 corresponding to the fan blade area 22, and the first shielding portion 12 and the second shielding portion 13 are integrally formed.

The fan blade includes a first blade 26, a second blade 27 and a connector 25, the first blade 26 and the second blade 27 are rotatably connected to the connector 25, and an output end of the driving device is in driving connection to the first blade 26 and the second blade 27 through the connector 25, so that the first blade 26 and the second blade 27 can droop naturally in a non-working state, and therefore, the volume of the handheld fan is reduced. When the handheld fan is in a working state, the first blade 26 and the second blade 27 rotate and are unfolded to achieve a blowing effect.

A cambered surface 24 is formed at a boundary between the handheld area 21 and a fan blade area 22.

Embodiment 2

Figure 5:
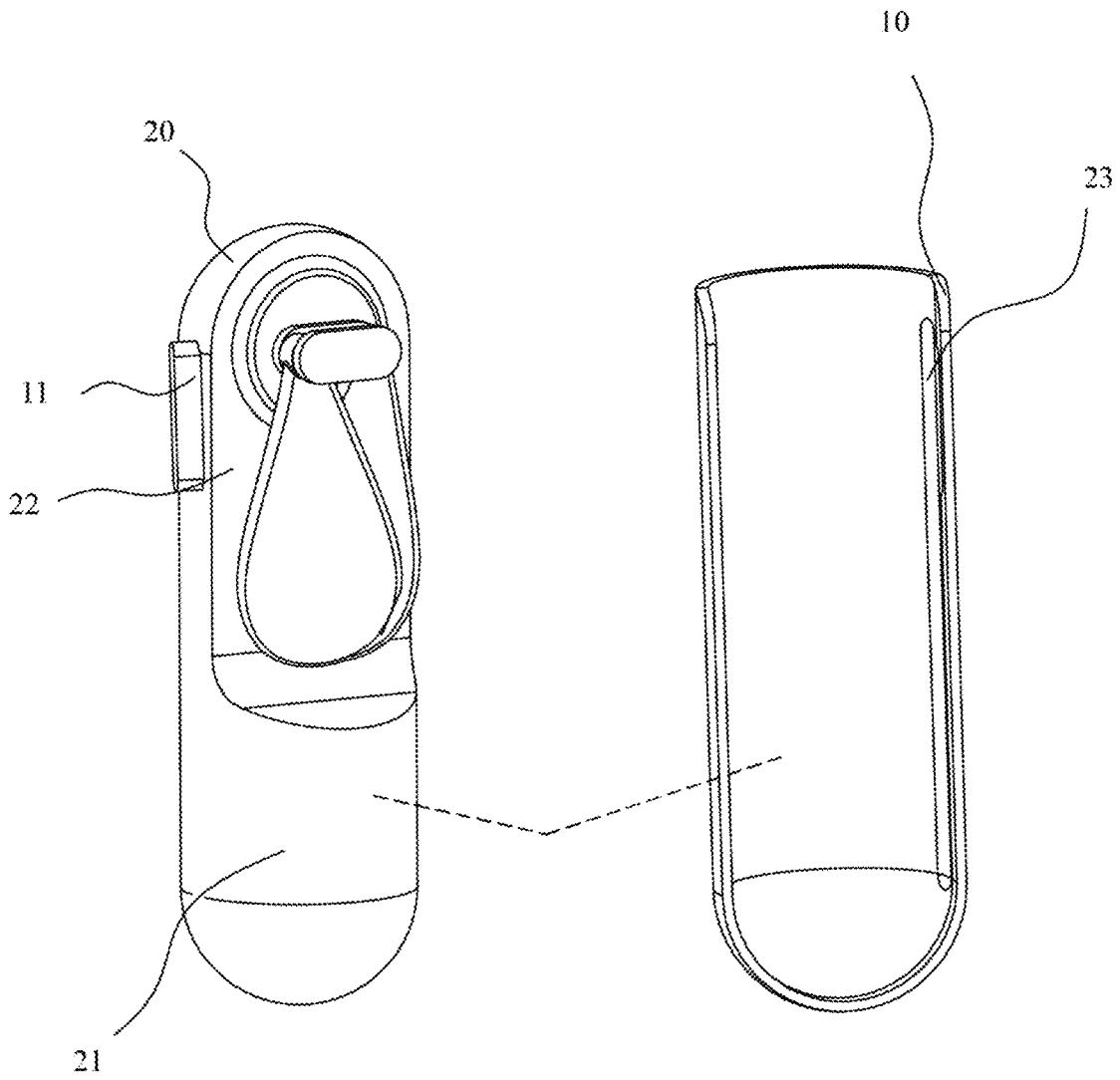
FIG. 5 is a schematic diagram of a breakdown structure of the embodiment 2 of the present invention.

As shown in FIG. 5, differences between the embodiment 2 and the embodiment 1 lie in that the positions of the sliding block 11 and the chute 23 are interchangeable, and there are only one sliding block 11 and chute 23; the sliding block 11 is arranged on a left side of the fan blade area 22, and the chute 23 is formed in a position, close to the second opening, of an inner wall of a left side wall, and extends longitudinally.

Embodiment 3

Figure 6:
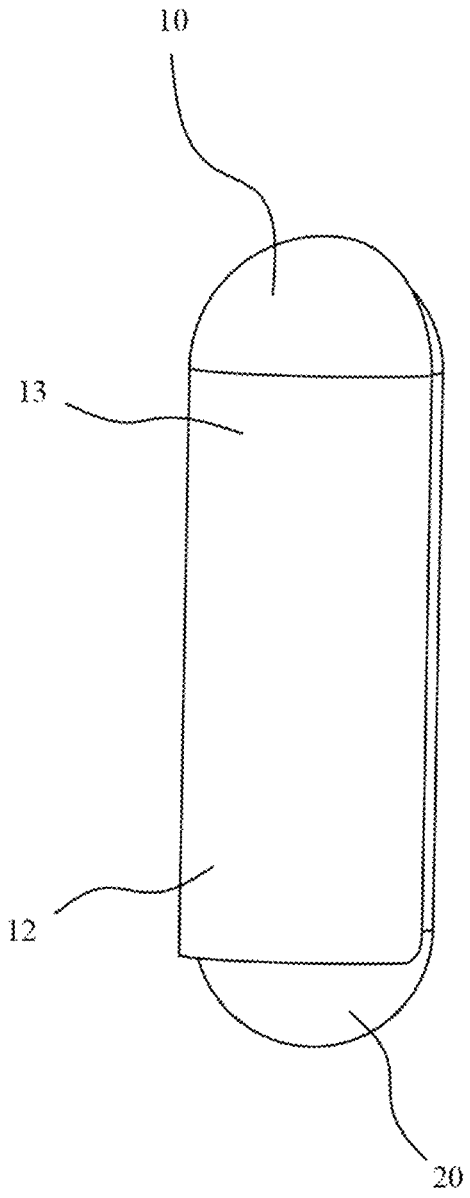
FIG. 6 is a schematic diagram of an assembled structure in a stored state of an embodiment 3 of the present invention.
Figure 7:
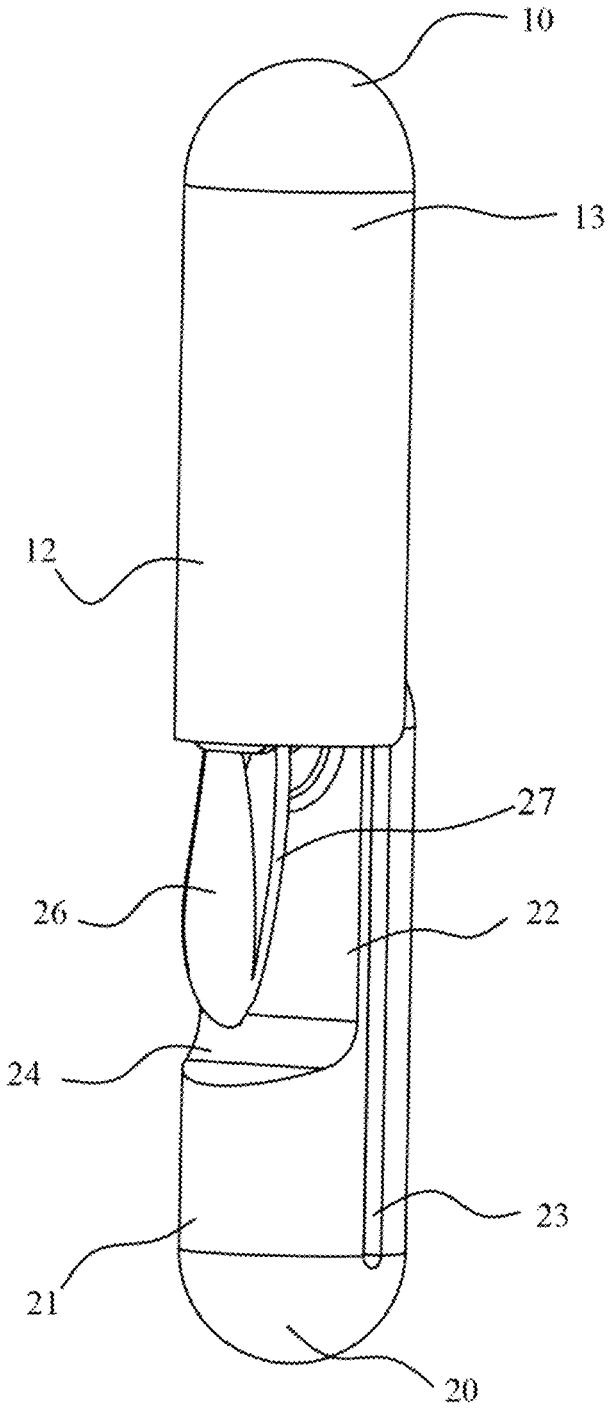
FIG. 7 is a schematic diagram of the assembled structure in a partially opened state of the embodiment 3 of the present invention.
Figure 8:
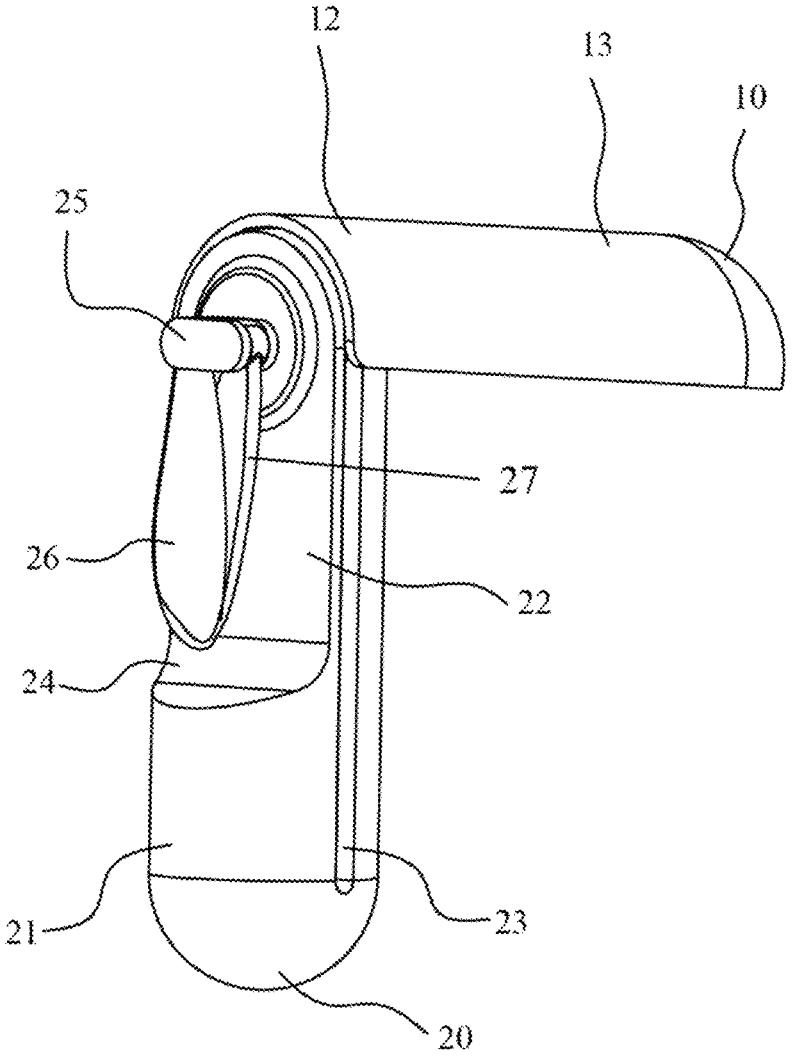
FIG. 8 is a schematic diagram of the assembled structure in a half-folded state of the embodiment 3 of the present invention.
Figure 9:
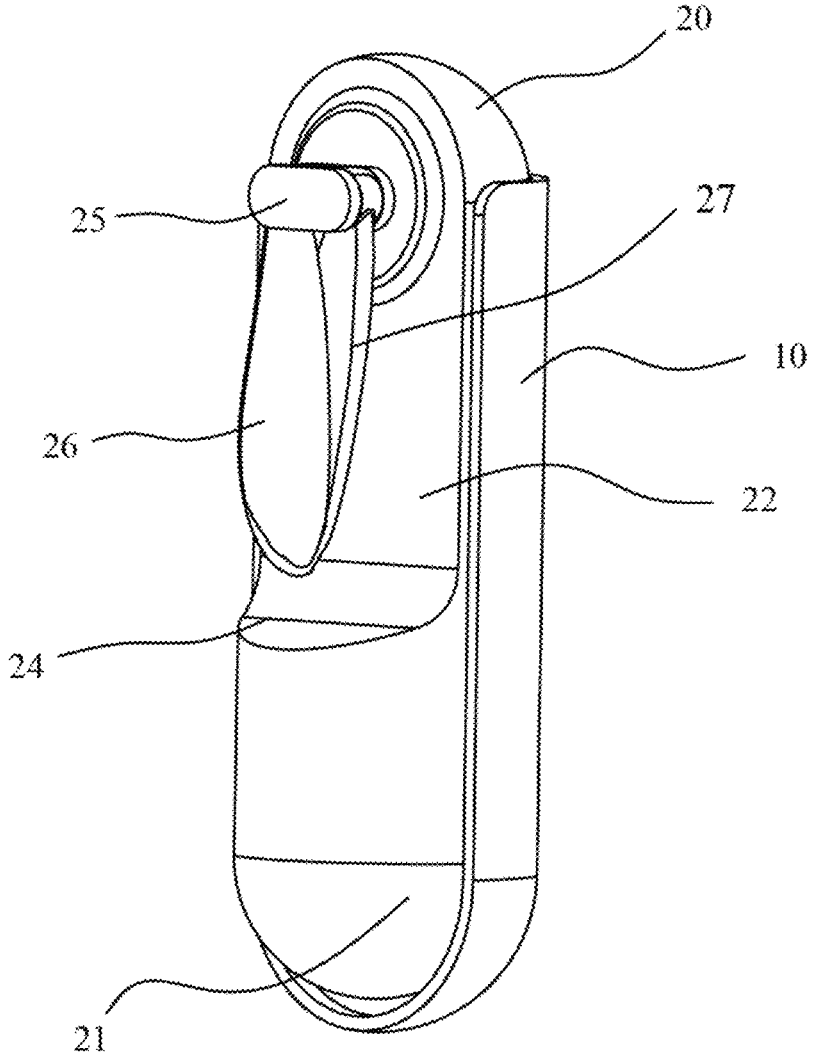
FIG. 9 is a schematic diagram of the assembled structure in a fully folded state of the embodiment 3 of the present invention.
Figure 10:
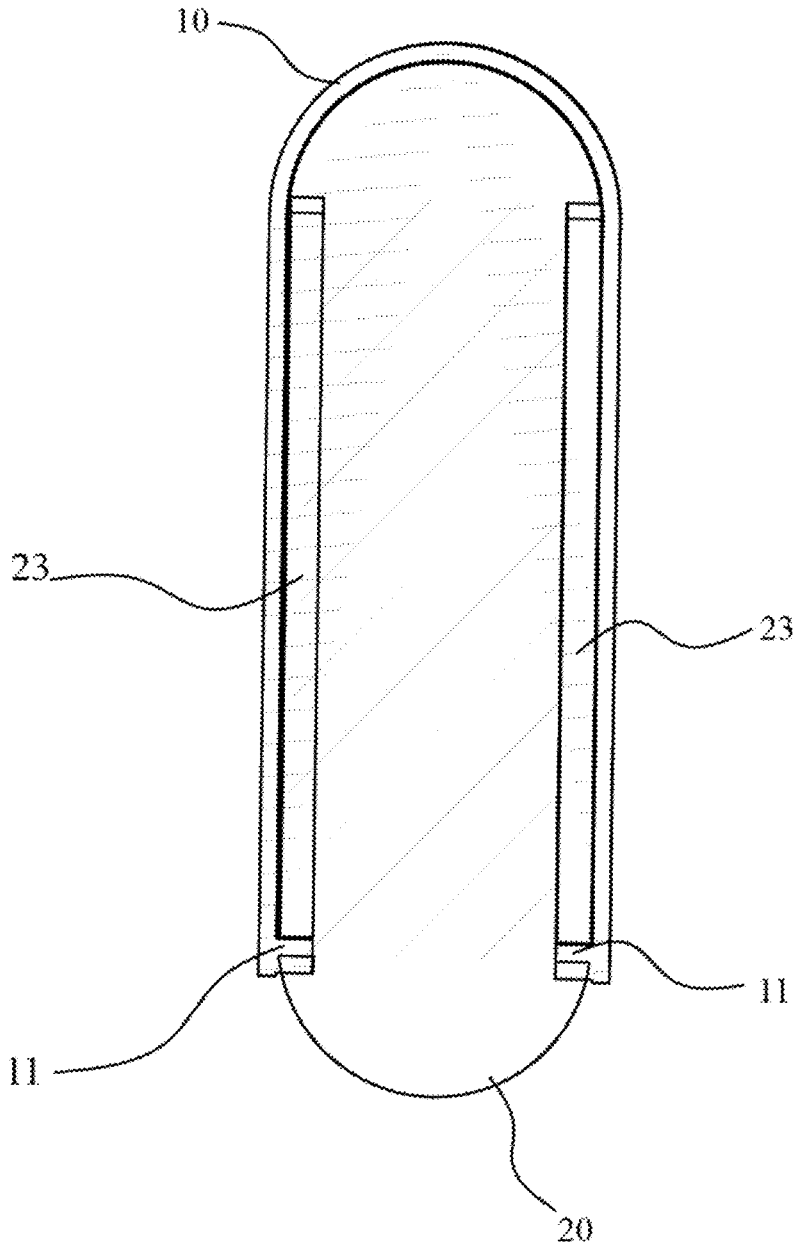
FIG. 10 is a section view of the embodiment 3 of the present invention.
Figure 11:
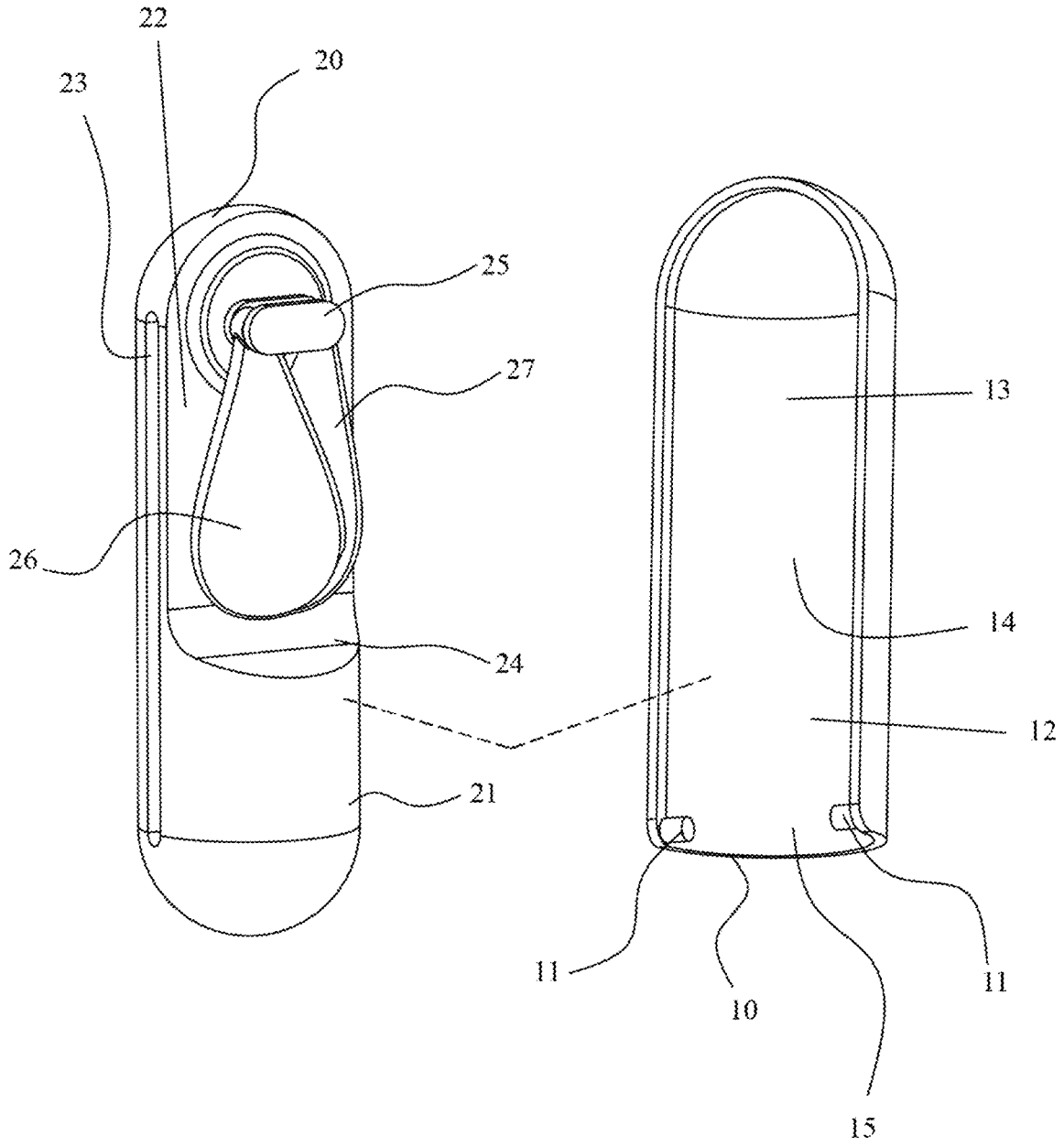
FIG. 11 is a schematic diagram of a breakdown structure of the embodiment 3 of the present invention.

As shown in FIGS. 6-11, differences between the embodiment 3 and the embodiment 1 lie in that the sliding block 11 is cylindrical, so that the housing cover 10 can slide up and down and turn front and back relative to the main body 20; as shown in FIG. 6, when the sliding block 11 slides to the bottommost end of the chute 23, the housing cover 10 can shield the fan blade area 22; as shown in FIG. 7, when the sliding block 11 slides to the uppermost end of the chute 23, the housing cover 10 exposes the fan blade area 22; moreover, as shown in FIG. 8, the housing cover 10 can further rotate relative to the main body 20 by taking the sliding block 11 as an axis; and as shown in FIG. 9, the housing cover 10 can at most turn at 180° relative to the main body 20, and finally, the housing cover 10 is stored behind the main body 20, and this storage mode further reduces the volume of the handheld fan.

Embodiment 4

Figure 12:
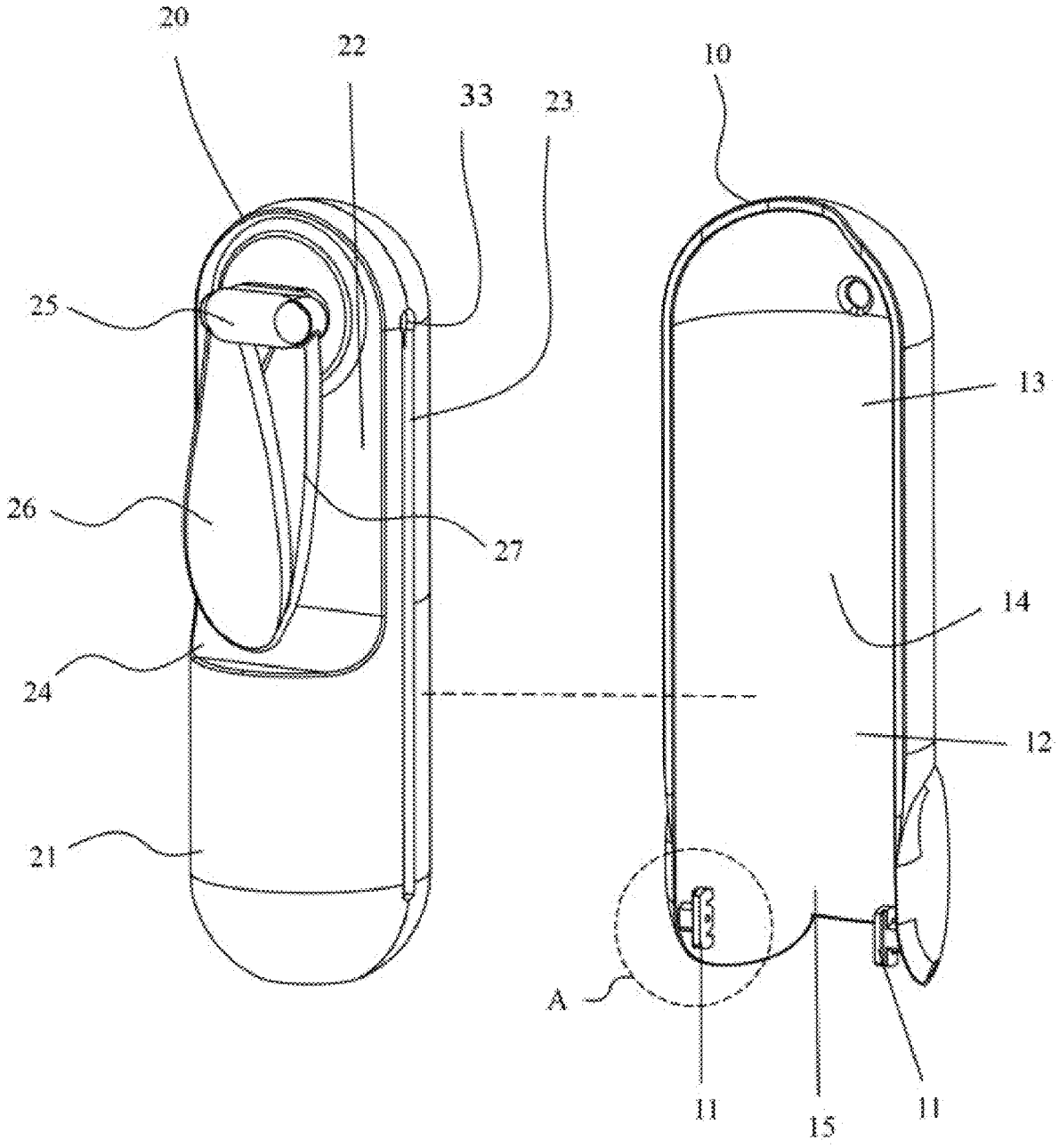
FIG. 12 is a schematic diagram of a breakdown structure of the embodiment 4 of the present invention.
Figure 13:
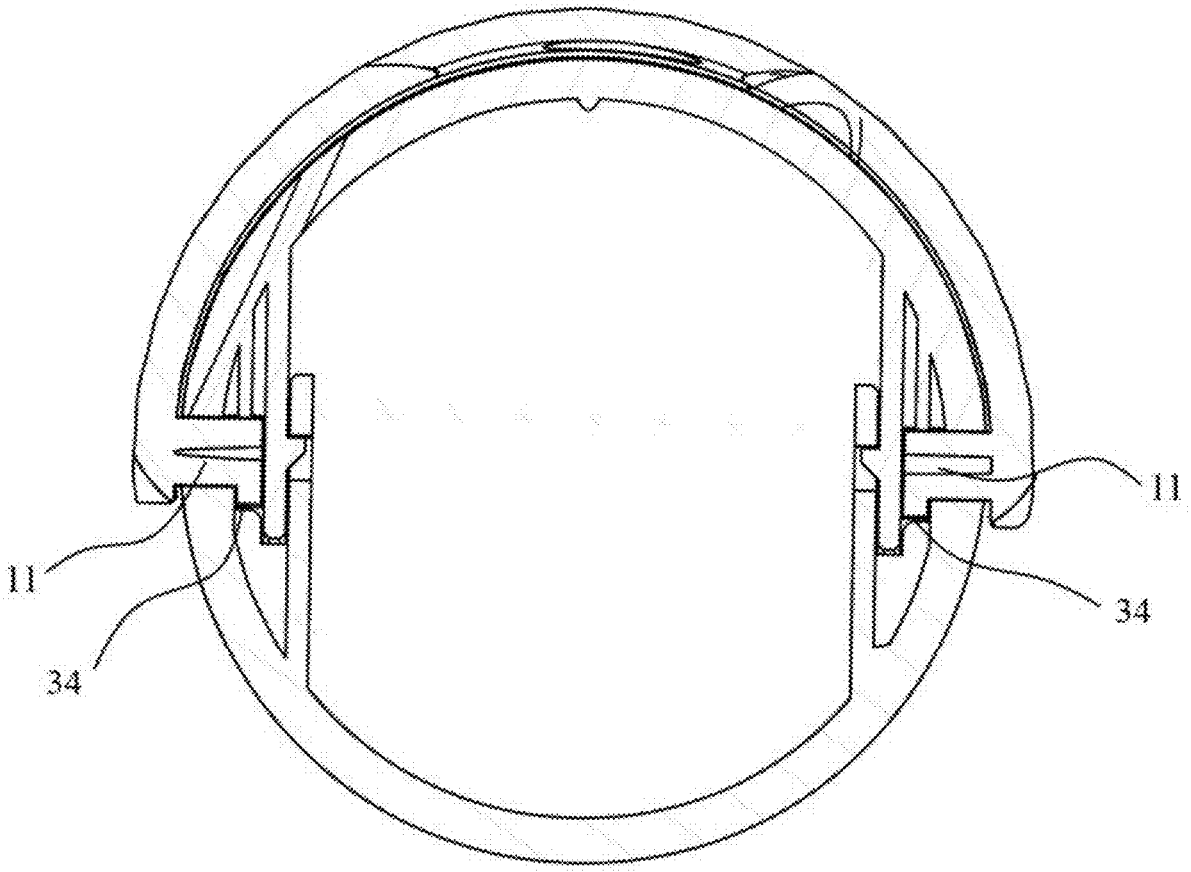
FIG. 13 is a section view of the embodiment 4 of the present invention.
Figure 14:
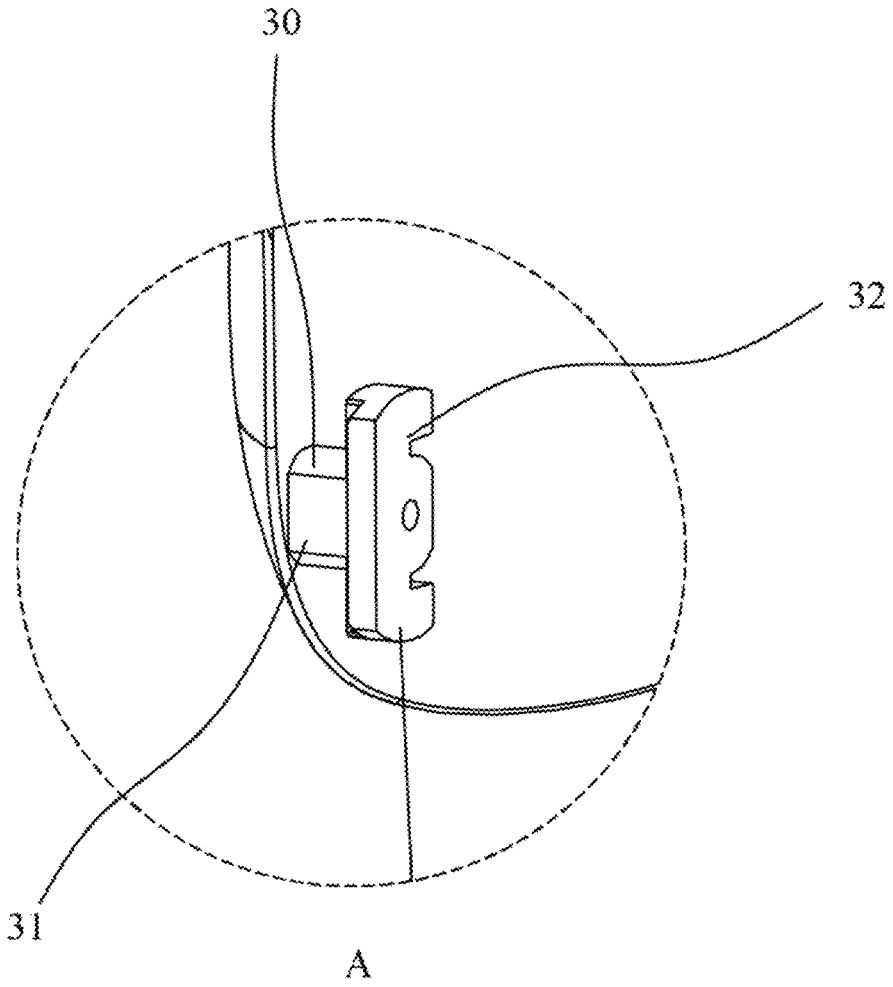
FIG. 14 is a partially enlarged schematic diagram of A in FIG. 12.

As shown in FIGS. 12-14, differences between the embodiment 4 and the embodiment 3 lie in that the sliding block 11 is T-shaped and includes a column portion 30 and a hook portion 32, the column portion 30 is provided with a section 31, the chute 23 is in clearance fit with the section 31, an end of the chute 23 is provided with a round hole 33, a non-section position of the column portion 30 is in clearance fit with the round hole 33, the hook portion 32 protrudes out of the column portion 30 radially, the chute 23 is further internally provided with an avoidance groove 34, and a width of the avoidance groove 34 is greater than the width of the chute 23, and the hook portion 32 stretches into the avoidance groove 34, so that the hook portion 32 is hooked in the main body 20, and therefore, the housing cover 10 can be effectively prevented from being separated from the main body 20; by embedding the sliding block 11 into the chute 23, the hook portion 32 protrudes out of the column portion 30 radially, and the section 31 is in clearance fit with the chute 23, so that the housing cover 10 can slide relative to the main body 20 longitudinally; when the housing cover 10 slides to the bottommost end of the chute 23, it can shield the fan blade area 22; the uppermost end of the chute 23 is provided with the round hole 33, and the round hole 33 is in clearance fit with the non-section position of the column 30, so that the housing cover 10 cannot turn when the sliding block 11 does not slide to the round hole 33 without controlling the direction of the housing cover 10 in the sliding process; and only when the sliding block 11 of the housing cover 10 moves to the round hole 33, can the hosing cover 10 rotate, so that the housing cover 10 is smoother to turn.

It is to be understood that the column portion 30 can further be provided with one or more sections 31.

In conclusion, by arranging the sliding connecting structure between the main body 20 and the housing cover 10, the housing cover 10 can slide relative to the main body 20, so that the main body 20 is stored in the housing cover 10, and therefore, the volume of the handheld fan is reduced and the handheld fan is convenient to store.

The above is merely the preferred embodiments of the present invention and is not used to limit the present invention. Therefore, any modification, equivalent substitution, improvement and etc. made on the above embodiments in accordance with the technical reality of the present invention shall fall within the scope of the technical solution of the present invention.

What is claimed is:

1. A handheld fan, comprising a main body, a housing cover and a fan blade, wherein the main body comprises a handheld area and a fan blade area longitudinally arranged, the main body is internally provided with a driving member configured to drive the fan blade to rotate; and a sliding connecting structure is arranged between the main body and the housing cover, the housing cover leans against the sliding connecting structure and slides relative to the main body, and the housing cover has two working positions, one for covering the fan blade area and the other for exposing the fan blade area;

wherein the sliding connecting structure comprises a chute and a sliding block, and the sliding block is embedded into the chute and is in clearance fit with the chute;

the chute is formed in the main body and extends longitudinally along the main body, and the sliding block is arranged on the housing cover;

the housing cover comprises a rear side wall, a left side wall, a right side wall and a lower side wall, a front side of the housing cover is opened to form a first opening, an upper side of the housing cover is opened to form a second opening, and the first opening is connected to the second opening.

2. The handheld fan according to claim 1, wherein the chute comprises at least two chutes that are respectively formed on left and right sides of the fan blade area.

3. The handheld fan according to claim 1, wherein the sliding block comprises at least two sliding blocks that are respectively arranged in positions, close to the second opening, of inner walls of the left side wall and the right side wall of the housing cover.

4. The handheld fan according to claim 1, wherein the sliding block is strip-shaped, and the sliding block extends longitudinally along the housing cover.

5. The handheld fan according to claim 1, wherein the sliding block is cylindrical.

6. The handheld fan according to claim 1, wherein the sliding block comprises a column portion, the column portion is provided with a section, the chute is in clearance fit with the section, and a width of a non-section position of the column portion is greater than a width of a section position of the column portion.

7. The handheld fan according to claim 6, wherein a tail end of the chute is provided with a round hole, the non-section position of the column portion is in clearance fit with the round hole, and a diameter of the round hole is greater than a width of the chute.

8. The handheld fan according to claim 1, wherein the sliding block is T-shaped and comprises a column portion and a hook portion, the hook portion protrudes out of the column portion radially, the chute is further internally provided with an avoidance groove, and a width of the avoidance groove is greater than the width of the chute, and the hook portion is in clearance fit with the avoidance groove.

9. The handheld fan according to claim 1, wherein the housing cover comprises a first shielding portion corresponding to the handheld area and a second shielding portion corresponding to the fan blade area.

10. The handheld fan according to claim 1, wherein the fan blade comprises a first blade, a second blade and a connector, the first blade and the second blade are rotatably connected to the connector, and an output end of the driving member is in driving connection to the first blade and the second blade through the connector.

* * * * *